US011139604B2

(12) United States Patent
Dai et al.

(10) Patent No.: US 11,139,604 B2
(45) Date of Patent: Oct. 5, 2021

(54) ELECTRICAL CONNECTOR

(71) Applicant: LOTES CO., LTD, Keelung (TW)

(72) Inventors: Yong Jun Dai, Keelung (TW); Chien Chih Ho, Keelung (TW); Jun Zhang, Keelung (TW)

(73) Assignee: LOTES CO., LTD, Keelung (TW)

( * ) Notice: Subject to any disclaimer, the term of this patent is extended or adjusted under 35 U.S.C. 154(b) by 0 days.

(21) Appl. No.: 17/031,128

(22) Filed: Sep. 24, 2020

(65) Prior Publication Data

US 2021/0175654 A1 Jun. 10, 2021

(30) Foreign Application Priority Data

Dec. 10, 2019 (CN) ..... 201911259462.4
Sep. 8, 2020 (CN) ..... 202010933553.8

(51) Int. Cl.

*H01R 13/41* (2006.01)
*H01R 13/24* (2006.01)
*H01R 12/58* (2011.01)
*H01R 13/50* (2006.01)

(52) U.S. Cl.

CPC ..... *H01R 13/41* (2013.01); *H01R 12/58* (2013.01); *H01R 13/2442* (2013.01); *H01R 13/2478* (2013.01); *H01R 13/2485* (2013.01); *H01R 13/50* (2013.01)

(58) Field of Classification Search

CPC .... H01R 13/41; H01R 13/50; H01R 13/2485; H01R 13/2478; H01R 43/16; H01R 12/58; H01R 13/2442

See application file for complete search history.

(56) References Cited

U.S. PATENT DOCUMENTS 8,366,453 B2 * 2/2013 Chang ..... H01R 12/58 439/70
8,641,449 B2 * 2/2014 Cai ..... H01R 13/6581 439/607.1
9,088,084 B2 * 7/2015 Liao ..... H01R 13/41
10,490,951 B2 * 11/2019 Chang ..... H05K 7/1069

FOREIGN PATENT DOCUMENTS

CN 108110451 A 6/2018

* cited by examiner

*Primary Examiner* — Briggitte R. Hammond
(74) *Attorney, Agent, or Firm* — Locke Lord LLP; Tim Tingkang Xia, Esq.

(57) ABSTRACT

An electrical connector includes an insulating body and multiple terminals accommodated in the insulating body. Each terminal has a base portion, a strip connecting portion extending upward from the base portion to be connected to a strip, and an elastic arm extending from the base portion. The elastic arm has a first tearing edge torn from the strip connecting portion, a second tearing edge torn from the strip, and a blanking edge blanked from the strip. The second tearing edge or the blanking edge has a dividing point. When each terminal is connected to the strip and expanded in a same vertical plane, the dividing point and a top point of the first tearing edge are vertically aligned. After the elastic arm is formed by bending, the dividing point and the first tearing edge are both located at a back side of the strip connecting portion.

10 Claims, 16 Drawing Sheets

100'

A–A

100

100

100

ELECTRICAL CONNECTOR

CROSS-REFERENCE TO RELATED PATENT APPLICATION

This non-provisional application claims priority to and the benefit of, pursuant to 35 U.S.C. § 119(a), patent application Serial No. CN201911259462.4 filed in China on Dec. 10, 2019, and patent application Serial No. CN202010933553.8 filed in China on Sep. 8, 2020. The disclosure of each of the above applications is incorporated herein in its entirety by reference.

Some references, which may include patents, patent applications and various publications, are cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference were individually incorporated by reference.

FIELD

The present invention relates to an electrical connector, and particularly to an electrical connector electrically connected to a chip module.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

An existing electrical connector includes a main body and a plurality of rows of terminals accommodated in the main body. Each terminal has a base portion, and a strip connecting portion and an elastic arm respectively extending upward from the base portion. The elastic arm is used to upward abut the chip module. The strip connecting portion is used to be connected to a strip. During assembly of the terminals, each strip is connected to the strip connecting portions of one row of terminals for insertion into the main body. After the assembly of the terminals, the strips are removed. To reduce the width of each terminal and allow the main body with a same size to accommodate more terminals, the strip connecting portion and the elastic arm may be formed by tearing. Thus, the elastic arm has a tearing edge formed by tearing from the strip connecting portion, and other edges of the elastic arm are formed by blanking from the corresponding strip. However, since the other edges of the elastic arm are formed by blanking from the corresponding strip, the material of each strip is wasted and is not conducive to saving the cost, and the width of elastic arm is reduced, thereby reducing the strength of the elastic arm and reducing the capacitance of the elastic arm, which is not conducive to high frequency characteristics.

Therefore, a heretofore unaddressed need to design a novel electrical connector exists in the art to address the aforementioned deficiencies and inadequacies.

SUMMARY

In view of the deficiency of the background, the present invention is directed to an electrical connector, which saves the material of the strips, and in the process of removing the strips, the strip does not easily collide and scratch the elastic arm of each terminal.

To achieve the foregoing objective, the present invention adopts the following technical solutions.

An electrical connector includes: an insulating body, provided with a plurality of accommodating holes running vertically through the insulating body; and a plurality of terminals, respectively correspondingly accommodated in the accommodating holes, wherein each of the terminals has a base portion positioned in a corresponding one of the accommodating holes, a strip connecting portion formed by extending upward from the base portion to be connected to a strip, and an elastic arm formed by bending and extending backward from the base portion and then bending and extending forward to upward abut a mating component, wherein the elastic arm has a first tearing edge formed by tearing from the strip connecting portion, a second tearing edge formed by tearing from the strip, and a blanking edge formed by blanking from the strip, and the second tearing edge or the blanking edge has a dividing point, wherein when each of the terminals is connected to the strip and expanded in a same plane along a vertical direction, the dividing point and a top point of the first tearing edge are vertically aligned, and a portion of the elastic arm passing upward beyond the dividing point is located at a side of the first tearing edge away from the strip connecting portion; and after the elastic arm is formed by bending, the dividing point and the first tearing edge are both located at a back side of the strip connecting portion.

In certain embodiments, after the elastic arm is formed by bending, the dividing point is lower than or flush with a top end of the strip connecting portion.

In certain embodiments, a connecting location of the strip corresponding to the second tearing edge and the blanking edge is concavely provided with a notch in a curve shape.

In certain embodiments, a connecting location between the blanking edge and the second tearing edge is concavely provided with a notch in a curve shape.

In certain embodiments, a through slot runs through the elastic arm in a front-rear direction, a bottom end of the through slot is higher than a bending location of the elastic arm connected to the base portion, and the bottom end of the through slot is lower than a top end of the strip connecting portion.

In certain embodiments, a through slot runs through the elastic arm in a front-rear direction, and viewing downward from an upper side, a free end of the elastic arm of a back terminal of the terminals and the through slot of a front terminal of the terminals partially overlap with each other.

In certain embodiments, a connecting portion is formed by extending downward from the base portion, two side portions are formed by bending and extending backward from a left side and a right side of the connecting portion, two extending portions are provided opposite to each other and formed by extending downward from the two side portions, two embracing arms are respectively correspondingly connected to lower ends of the two extending portions, the two embracing arms retain a solder ball, the solder ball defines a first vertical central plane along a front-rear direction and a second vertical central plane along a left-right direction, the second vertical central plane is perpendicular to the first vertical central plane, the two embracing arms are located respectively at a left side and a right side of the first vertical central plane, a front end of each of the two embracing arms passes forward beyond a front end of a corresponding one of the two extending portions, a distance of the front end of each of the two embracing arms passing forward beyond the second vertical central plane is greater than a distance of a back end of each of the two embracing arms passing backward beyond the second vertical central plane, such that a distance between the front ends of the two embracing arms is less than a distance between the back ends of the two embracing arms, and the front ends of the two embracing arms are close to each other, such that the front ends of the two embracing arms are both attached with molten solder formed by the solder ball being melted during soldering.

In certain embodiments, the insulating body is provided with a stopping portion, and the stopping portion is located above the front ends of the two embracing arms to stop the front ends of the two embracing arms from moving upward.

In certain embodiments, a portion of each of the two embracing arms passing forward beyond the front end of the corresponding one of the two extending portions is defined as a first protruding portion, each of the two embracing arms has a second protruding portion passing backward beyond a back end of the corresponding one of the two extending portions, a length of the first protruding portion is greater than a length of the second protruding portion, and the second vertical central plane passes the two extending portions.

Further, in another aspect of the present invention, an electrical connector includes: an insulating body, provided with a plurality of accommodating holes running vertically through the insulating body; and a plurality of terminals, respectively correspondingly accommodated in the accommodating holes, wherein each of the terminals has a base portion positioned in a corresponding one of the accommodating holes, a strip connecting portion formed by extending upward from the base portion to be connected to a strip, and an elastic arm formed by bending and extending backward from the base portion and then bending and extending forward to upward abut a mating component, wherein the elastic arm has a tearing edge formed by tearing from the strip connecting portion, and a side edge of the terminal has a dividing point above the tearing edge, wherein when each of the terminals is connected to the strip and expanded in a same plane along a vertical direction, the dividing point and a top point of the tearing edge are vertically aligned, and a portion of the elastic arm passing upward beyond the dividing point is located at a side of the tearing edge away from the strip connecting portion; and in a process for the mating component to press downward on the elastic arm, the dividing point and the tearing edge are always located at a back side of the strip connecting portion, and the dividing point is lower than or flush with a top end of the strip connecting portion.

Compared with the related art, the electrical connector according to certain embodiments of the present invention has the following beneficial effects. The elastic arm has the first tearing edge formed by tearing from the strip connecting portion and the second tearing edge formed by tearing from the strip, thus saving the material of the strips, which is conducive to save the cost, and increasing the width of the elastic arm, thereby increasing the strength of the elastic arm and increasing the capacitance of the elastic arm, which is conducive to high frequency characteristics. When each of the terminals is connected to the strip and expanded in a same plane along a vertical direction, the dividing point and a top point of the first tearing edge are vertically aligned, and a portion of the elastic arm passing upward beyond the dividing point is located at a side of the first tearing edge away from the strip connecting portion. Thus, a gap and no contact exists between the portion of the elastic arm passing upward beyond the dividing point and the strip. After the elastic arm is formed by bending, the dividing point and the first tearing edge are both located at a back side of the strip connecting portion. Thus, a gap exists in the front-rear direction between the strip and the dividing point, and in the process of folding the strip in the front-rear direction, the strip does not easily collide and scratch the elastic arm, and the terminal does not easily turn and deform, which is conducive to the normal usage of the electrical connector.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the disclosure and together with the written description, serve to explain the principles of the disclosure. Wherever possible, the same reference numbers are used throughout the drawings to refer to the same or like elements of an embodiment, and wherein.

DETAILED DESCRIPTION

Figure 1:
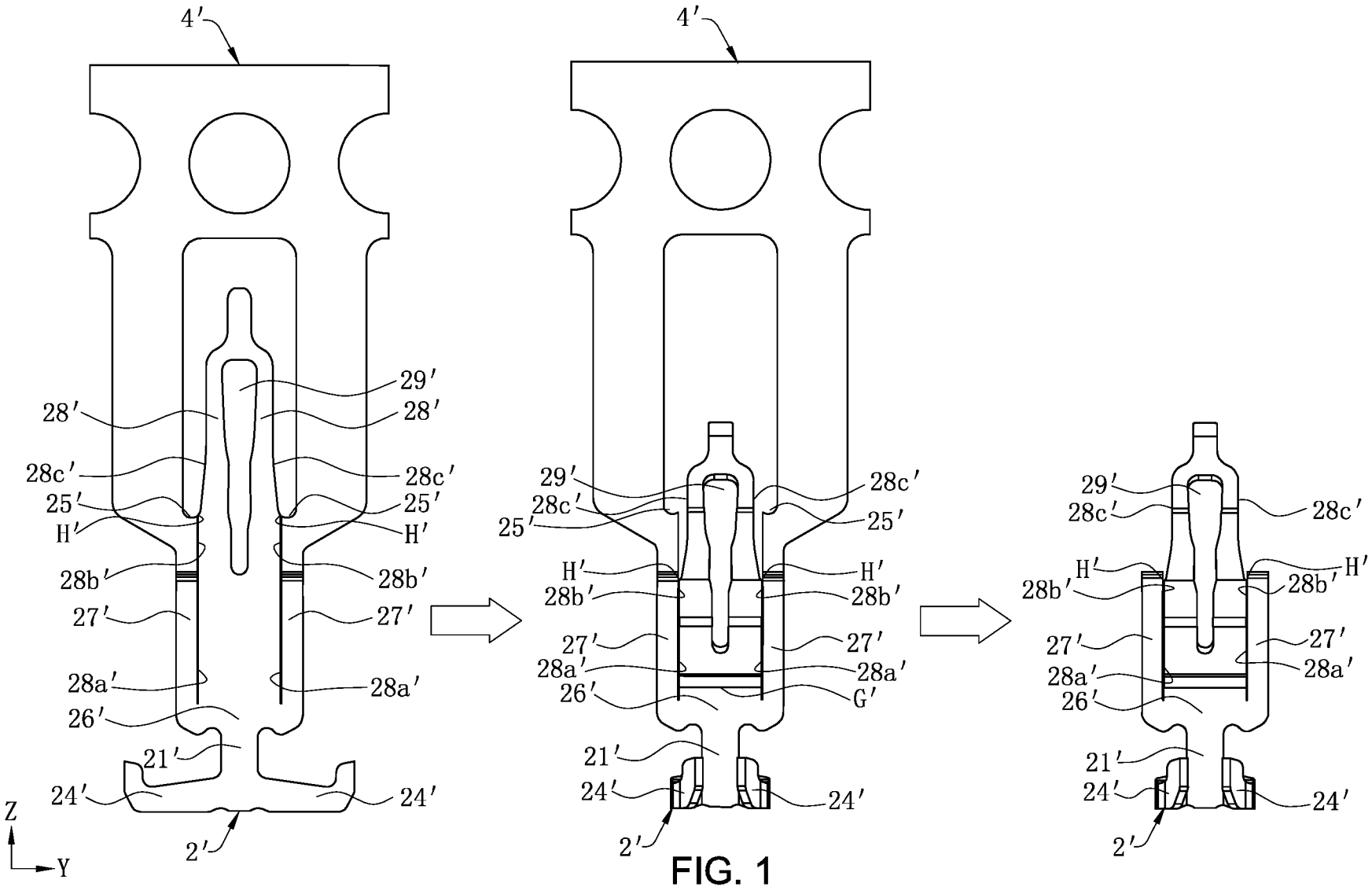
FIG. 1 is a schematic view of the process of forming a terminal of an electrical connector according to a first embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-16. In accordance with the purposes of this invention, as embodied and broadly described herein, this invention, in one aspect, relates to an electrical connector.

FIG. 3 to FIG. 6 show an electrical connector 100' according to a first embodiment of the present invention. The electrical connector 100' includes an insulating body 1' and a plurality of terminals 2' positioned in the insulating body 1', and the electrical connector 100' is used to electrically connect a mating component 200' and a circuit board 300'. In this embodiment, the mating component 200' is a chip module. An extending direction of the X-axis is defined as a front-rear direction (where the positive direction of the X-axis is the forward direction), an extending direction of the Y-axis is defined as a left-right direction (where the positive direction of the Y-axis is the rightward direction), and an extending direction of the Z-axis is defined as a vertical direction (where the positive direction of the Z-axis is the upward direction).

Figure 3:
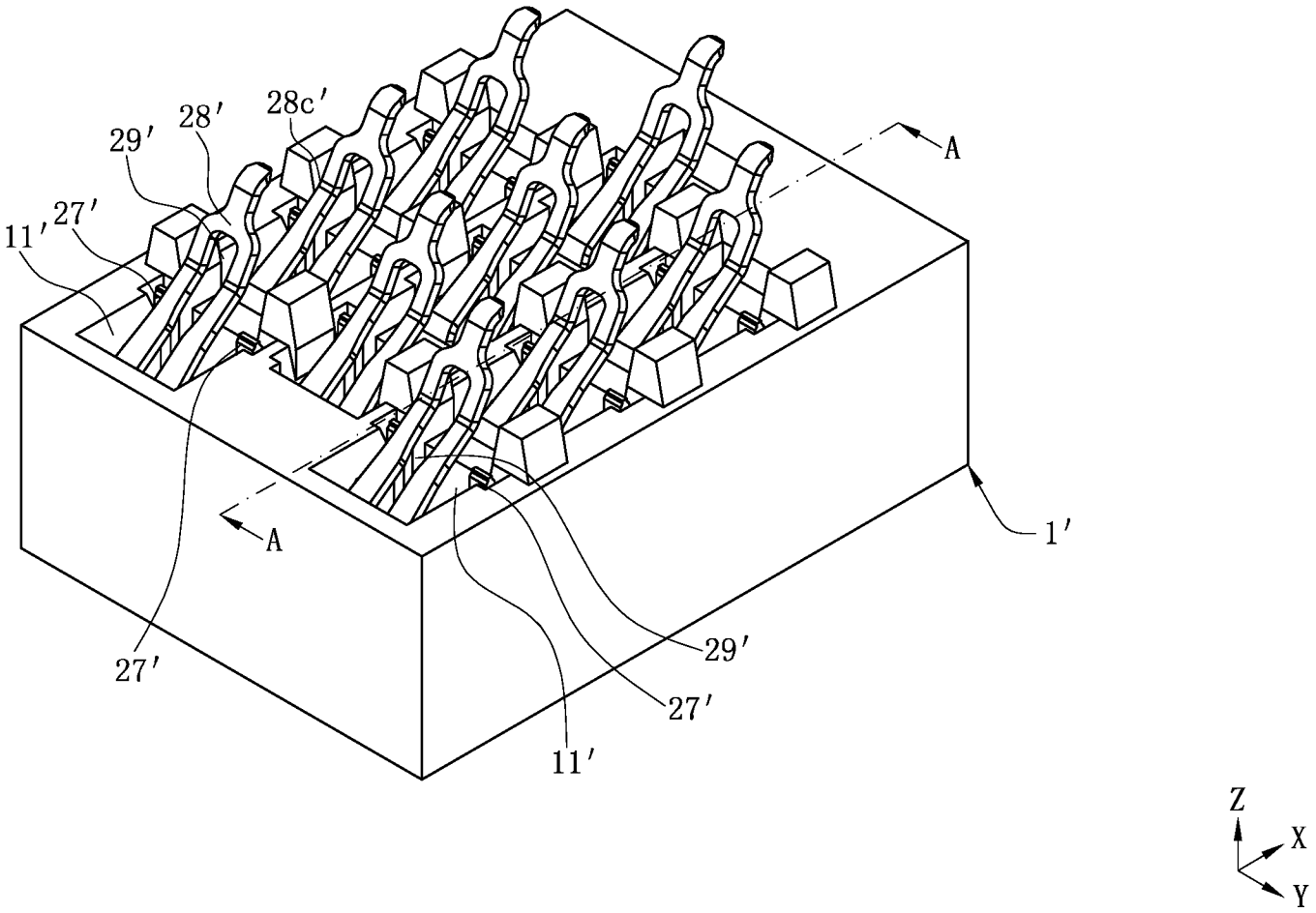
FIG. 3 is a perspective view of the electrical connector according to the first embodiment of the present invention.
Figure 4:
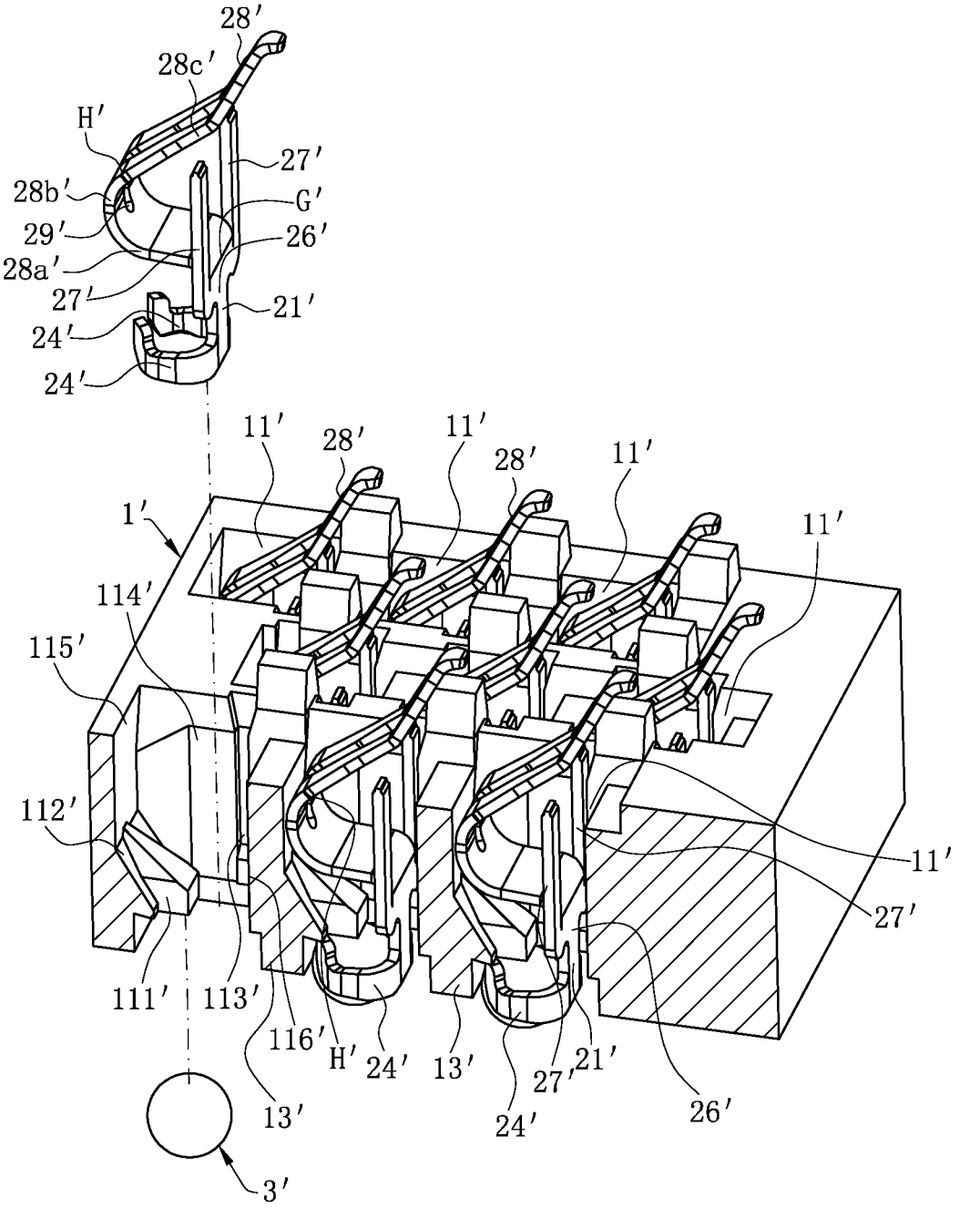
FIG. 4 is a sectional view of FIG. 3 along line A-A.
Figure 4:
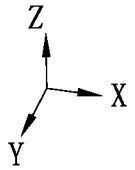

As shown in FIG. 3 and FIG. 4, the insulating body 1' is provided with a plurality of accommodating holes 11' running vertically therethrough to correspondingly accommodate the terminals 2'. Each accommodating hole 11' has two side walls 114' opposite to each other and a rear wall 115' connecting the two side walls 114'. Each side wall 114' has a fixing slot 113'. The rear wall 115' has a position limiting block 111' and two guiding blocks 112' respectively located at two opposite sides of the position limiting block 111'. The fixing slot 113' runs upward through the insulating body 1' but does not run downward through the insulating body 1'. A width of the position limiting block 111' and a width of each of the guiding blocks 112' gradually increase along a downward direction from top thereof. The position limiting block 111' protrudes forward to pass beyond the guiding blocks 112'.

Figure 2:
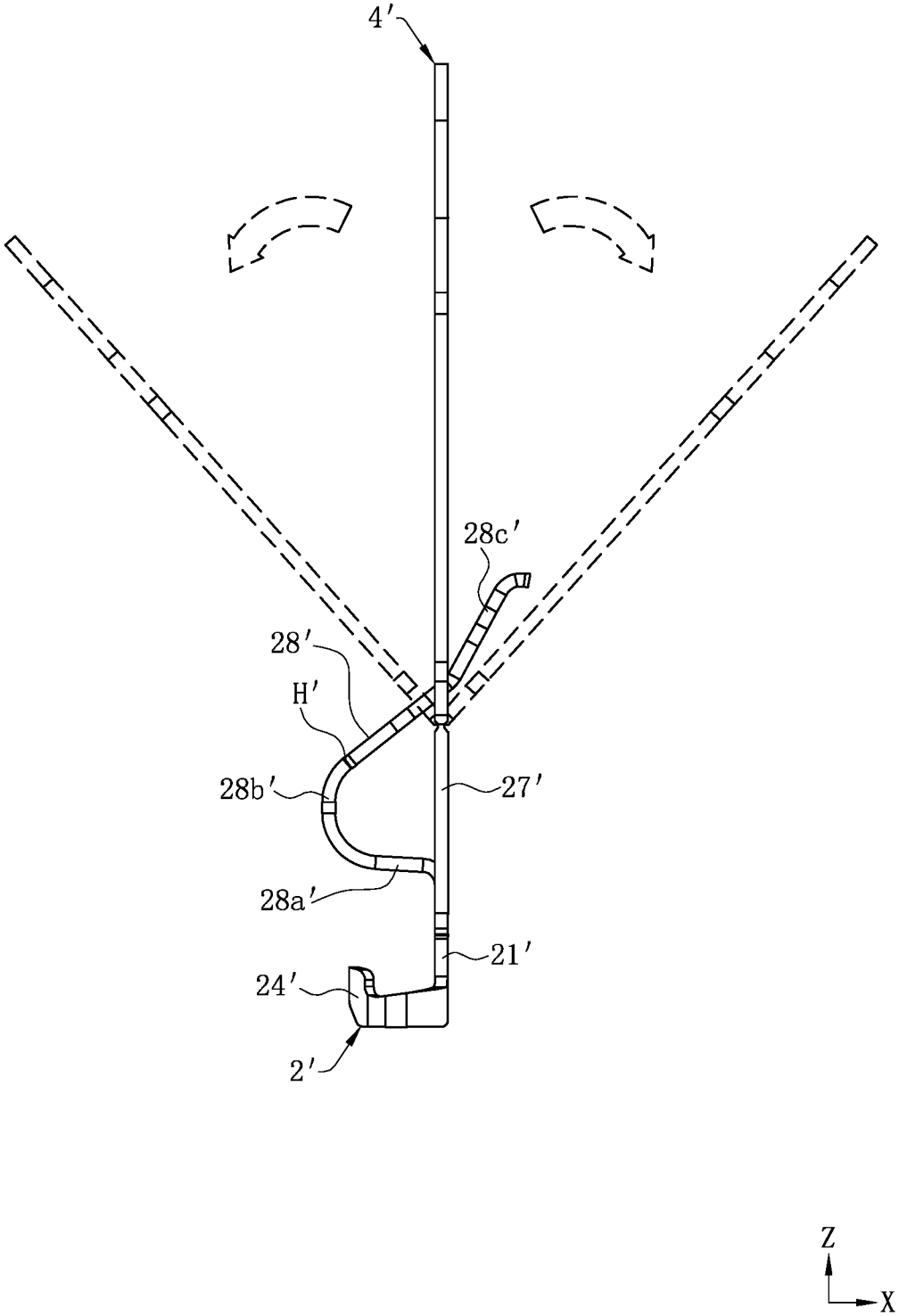
FIG. 2 is a schematic view of FIG. 1 in which the strip is removed.

As shown in FIG. 1 to FIG. 3, each row of terminals 2' and a strip 4' are formed by punching a same metal plate, such that each strip 4' is connected to one row of terminals 2'. (For simplifying purposes, FIG. 1 only shows a strip 4' connected to one terminal 2'.) During assembly of the terminals 2', each strip 4' is connected to the one row of terminals 2' for insertion into the insulating body 1'. After the assembly of the terminals 2', the strip 4' is removed. Each terminal 2' has a base portion 26' positioned in a corresponding accommodating hole 11', two strip connecting portions 27' formed by respectively extending vertically upward from a left side and a right side of the base portion 26' to be connected to a strip 4', and an elastic arm 28' formed by bending and extending backward and then bending and extending forward to upward abut the mating component 200'. The elastic arm 28' is located between the two strip connecting portions 27'. Each of the two side edges of the elastic arm 28' has a first tearing edge **28*a*' formed by tearing from the corresponding strip connecting portion 27', a second tearing edge 28*b*' formed by tearing from the strip 4', and a blanking edge 28*c*' formed by blanking from the strip 4'. The second tearing edge 28*b*' is connected to an upper end of the first tearing edge 28*a*' and connected to a lower end of the blanking edge 28*c*', and a sum of a length of the first tearing edge 28*a*' and a length of the second tearing edge 28*b*' is less than a length of the blanking edge 28*c*'. The two first tearing edges 28*a*', and two second tearing edges 28*b*' and the two blanking edges 28*c*' at the left side and the right side of each elastic arm 28' are symmetrically provided. A distance between the two first tearing edges 28*a*' is equal to a distance between the two second tearing edges 28*b*', and is greater than a distance between the two blanking edges 28*c*'. A connecting location of the strip 4' corresponding to the second tearing edge 28*b*' and the blanking edge 28*c*' is concavely provided with a notch 25' in a curve shape. Each terminal 2' and the corresponding strip 4' are formed by punching the same metal plate, and the second tearing edge 28*b*' is formed by tearing from the strip 4', allowing full utilization of the plate material. The second tearing edge 28*b*' or the blanking edge 28*c*' has a dividing point H'. (In this embodiment, the dividing point H' is a top point of the second tearing edge 28*b*'.) When each terminal 2' is connected to the strip 4' and expanded in a same plane along the vertical direction, the dividing point H' and a top point of the first tearing edge 28*a*' are vertically aligned (in this embodiment, the first tearing edge 28*a*' and the corresponding second tearing edge 28*b*' are located on a same vertical line), and a portion of the elastic arm 28'** passing upward beyond the dividing point H' is located at a side of the first tearing edge 28*a*' away from the corresponding strip connecting portion 27'. That is, along the left-right direction, the portion of the elastic arm 28' passing upward beyond the dividing point H' is located between the two strip connecting portions 27', and a gap and no contact exists between the portion of the elastic arm 28' passing upward beyond the dividing point H' and the strip 4'. After the elastic arm 28' is formed by bending, the dividing point H' and the first tearing edge 28*a*' are both located at a back side of the corresponding strip connecting portion 27'.

As shown in FIG. 1 and FIG. 2, specifically, in this embodiment, the second tearing edge 28*b*' is a vertical edge, and the blanking edge 28*c*' at the same side is located at a side of the first tearing edge 28*a*' away from the corresponding strip connecting portion 27'. The dividing point H' is the top point of the second tearing edge 28*b*'. That is, along the left-right direction, the portion of the elastic arm 28' passing upward beyond the dividing point H' is located between the two strip connecting portions 27', and a gap and no contact exists between the portion of the elastic arm 28' passing upward beyond the dividing point H' and the strip 4'. After the elastic arm 28' is formed by bending along the front-rear direction, the top point of the second tearing edge 28*b*' and the first tearing edge 28*a*' are both located at a back side of the corresponding strip connecting portion 27'. Thus, in the process of removing the strip 4', the strip 4' does not easily collide and scratch the elastic arm 28' and the terminal 2' does not easily turn and deform. In addition to the full utilization of the plate material, the terminal 2' has good stability, which is conducive to the normal usage of the electrical connector 100'.

As shown in FIG. 2, after the elastic arm 28' is formed by bending along the front-rear direction, the top point of the second tearing edge 28*b*' is lower than or flush with a top end of the corresponding strip connecting portion 27'. In the process of removing the strip 4' from the corresponding strip connecting portion 27' (where a degree of folding the strip 4' in the front-rear direction is less than 90°), it is further ensured that the strip 4' does not collide and scratch the second tearing edge 28*b*', the terminal 2' does not easily turn and deform, and the terminal 2' has good stability.

Figure 6:
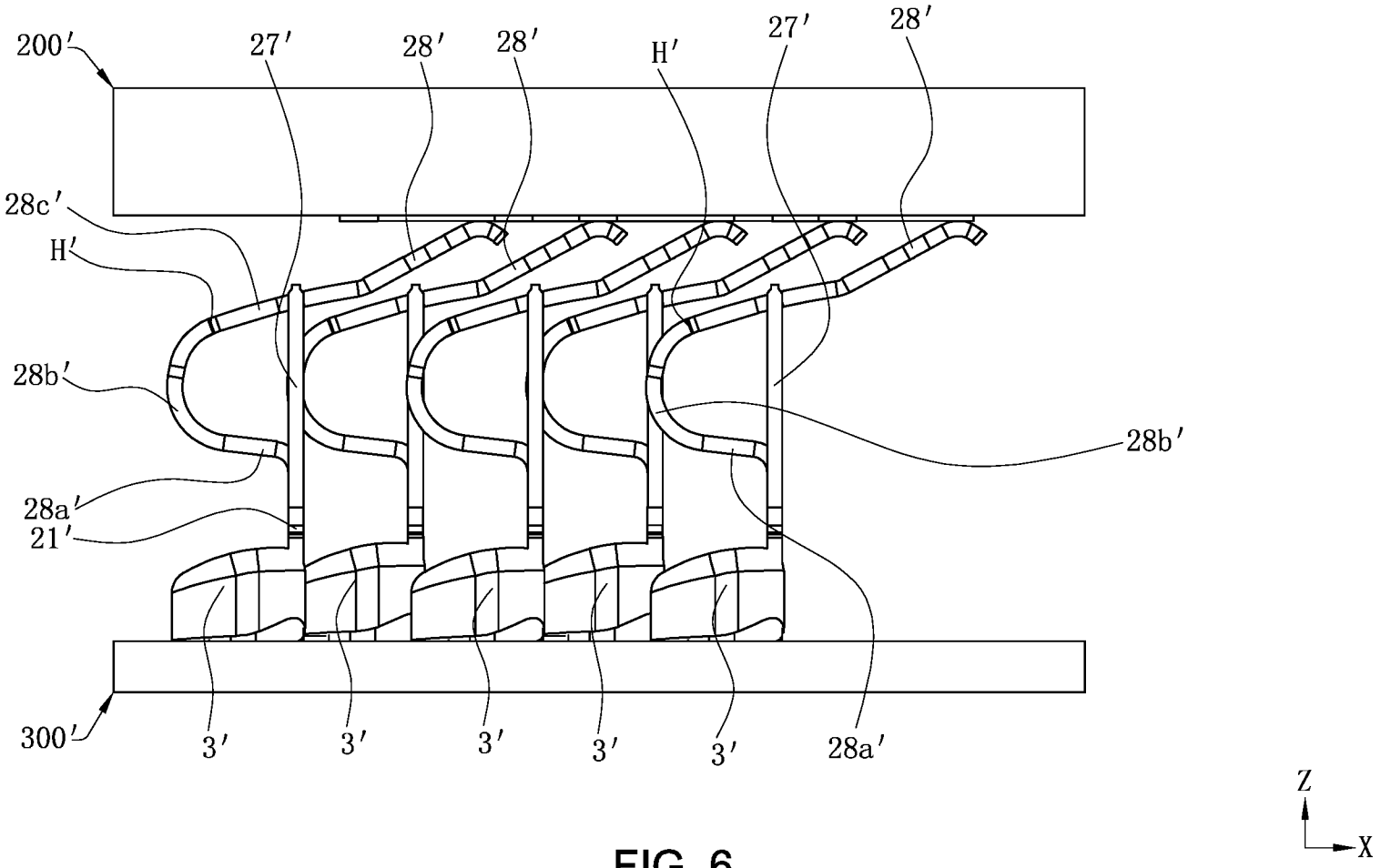
FIG. 6 is a side view of the terminals of the electrical connector electrically connecting a mating component and a circuit board according to the first embodiment of the present invention, where the insulating body is removed.
Figure 7:
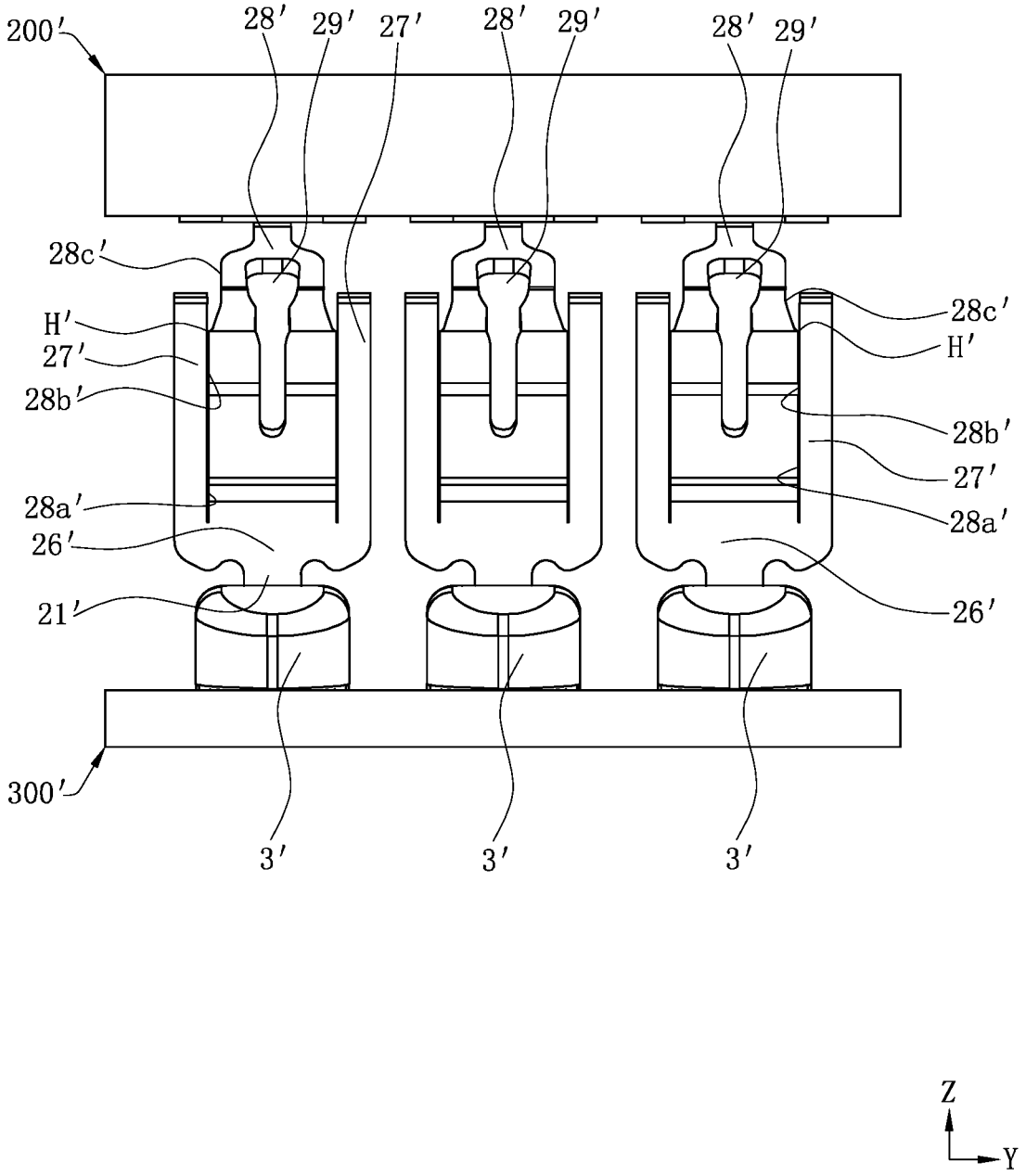
FIG. 7 is a rear view of FIG. 6.

As shown in FIG. 2 and FIG. 6, in the process of the mating component 200' pressing downward on the elastic arm 28', the top point of the second tearing edge 28*b*' and the first tearing edge 28*a*' are always located at a back side of the corresponding strip connecting portion 27', such that the corresponding strip connecting portion 27' is not in contact with the second tearing edge 28*b*'. Thus, the terminal 2' does not easily turn and deform, and the terminal 2' has good stability. Further, the top point of the second tearing edge 28*b*' is located below the corresponding strip connecting portion 27', further ensuring that, in this process, the elastic arm 28' is not collided and scratched by the corresponding strip connecting portion 27', and the terminal 2' has good stability, and reducing an overall height of the electrical connector 100'.

As shown in FIG. 1, the elastic arm 28' has a through slot 29' running through the elastic arm 28' in the front-rear direction, which is conducive to reducing the self-inductance effect of the elastic arm 28' and increasing the elasticity of the elastic arm 28'. A bending location G' of the elastic arm 28' connected to the base portion 26' is distanced from a bottom end of the through slot 29'. In other words, the through slot 29' does not extend downward to the bending location G' of the elastic arm 28' connected to the base portion 26' (in this embodiment, the bottom end of the through slot 29' is flush with the top point of the first tearing edge 28*a*'), the bottom end of the through slot 29' is higher than the bending location G' of the elastic arm 28' connected to the base portion 26', and the bottom end of the through slot 29' is lower than the top end of the corresponding strip connecting portion 27'. When the mating component 200' presses downward on the elastic arm 28', the elastic arm 28' as a whole moves forward, and if the strength of the elastic arm 28' is not sufficient, it may easily result in the elastic arm 28' moving excessively forward, and may further result in stress relaxation of the elastic arm 28', which cannot return from its deformation. Thus, the through slot 29' does not extend downward to the bending location G' of the elastic arm 28' connected to the base portion 26', thus ensuring the strength of the elastic arm 28', and ensuring the elastic arm 28' not to move excessively forward.

Figure 5:
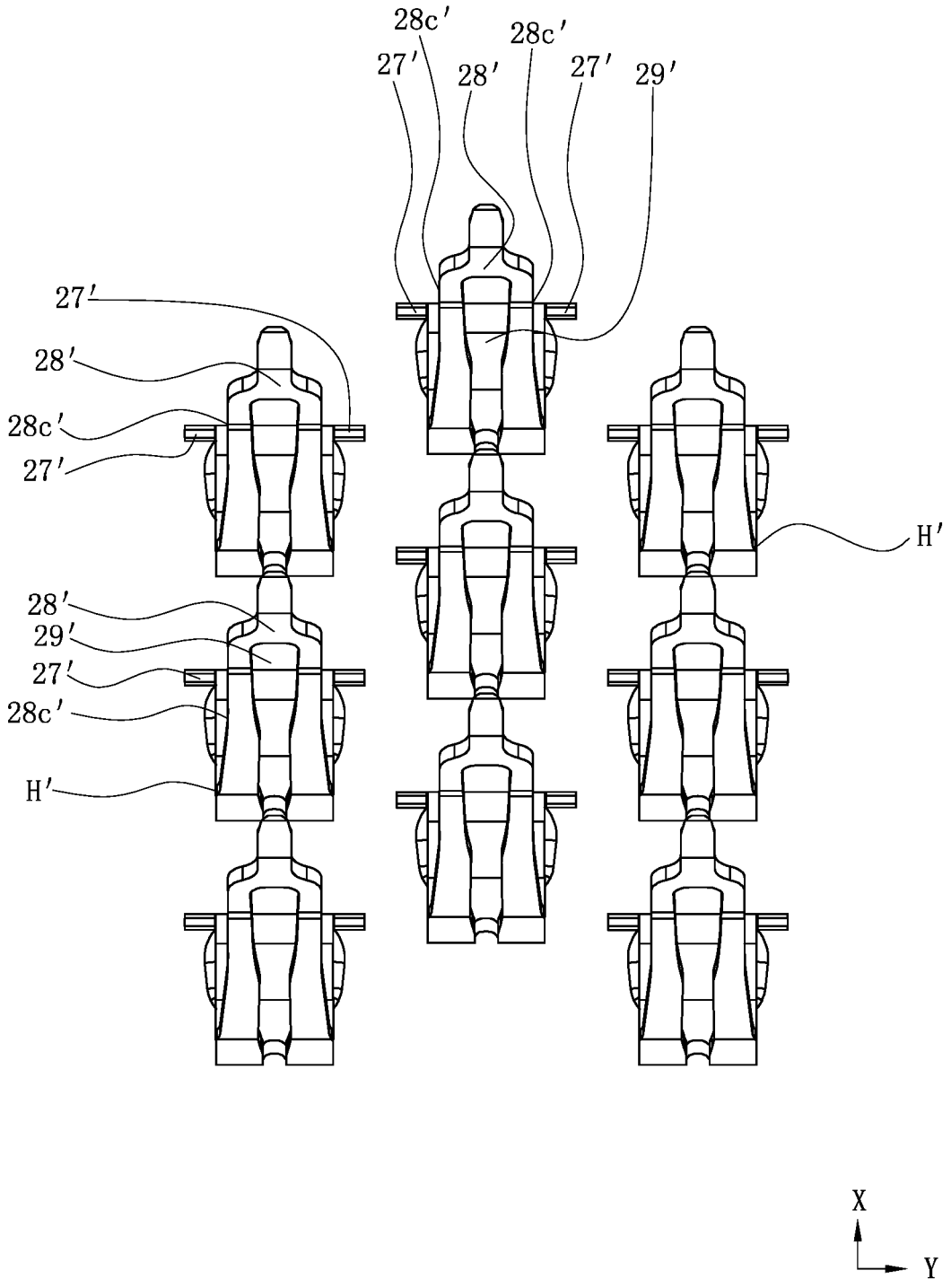
FIG. 5 is a top view of the arrangement of the terminals of the electrical connector according to the first embodiment of the present invention (where the insulating body is removed).

As shown in FIG. 5, viewing downward from an upper side, a free end of the elastic arm 28' of a back terminal 2' located behind and the through slot 29' of a front terminal 2' located in front partially overlap with each other, which is conducive to reducing an interval between the adjacent terminals 2' in the front-rear direction, preventing the free end of the elastic arm 28' of the back terminal 2' from contacting the elastic arm 28' of the front terminal 2', and facilitating the normal signal transmission. Otherwise, when the mating component 200' presses downward excessively, and the interval between the adjacent terminals 2' in the front-rear direction is too small, the free end of the elastic arm 28' of the back terminal 2' may be easily in contact with the elastic arm 28' of the front terminal 2', thus resulting in signal short-circuiting, and further affecting the normal usage of the electrical connector 100'.

As shown in FIG. 3 and FIG. 4, a connecting portion 21' is formed by extending downward from the base portion 26'. Two embracing arms 24' are formed by bending and extending from a left side and a right side of the connecting portion 21', and the two embracing arms 24' retains a solder ball 3'. In the process of assembling the terminal 2' into the corresponding accommodating hole 11' downward from top thereof, the embracing arms 24' correspondingly move downward along the guiding blocks 112' and finally move to be below the guiding blocks 112', and the guiding blocks 112' limits the embracing arms 24' from moving upward. The position limiting block 111' is located above the solder ball 3' to stop the solder ball 3' from moving upward excessively in the process of mounting into the corresponding accommodating hole 11'. The strip connecting portions 27' are fixed in the fixing slots 113', and the fixing slots 113' limit the strip connecting portions 27' from moving in the front-rear and left-right directions. A lower end of the base portion 26' abuts a bottom surface of each fixing slot 113', and the fixing slots 113' limit the base portion 26' from moving downward. Since the fixing slots 113' limit the terminal 2' from moving in the front-rear, left-right and downward directions, and the guiding blocks 112' limit the terminal 2' from moving upward, the terminal 2' may be stably fixed in the corresponding accommodating hole 11'.

FIG. 8 to FIG. 16 show an electrical connector 100 according to a second embodiment of the present invention. The electrical connector 100 is used to electrically connect a mating component 200 and a circuit board 300. The electrical connector 100 includes an insulating body 1 and a plurality of terminals 2 positioned in the insulating body 1.

Figure 9:
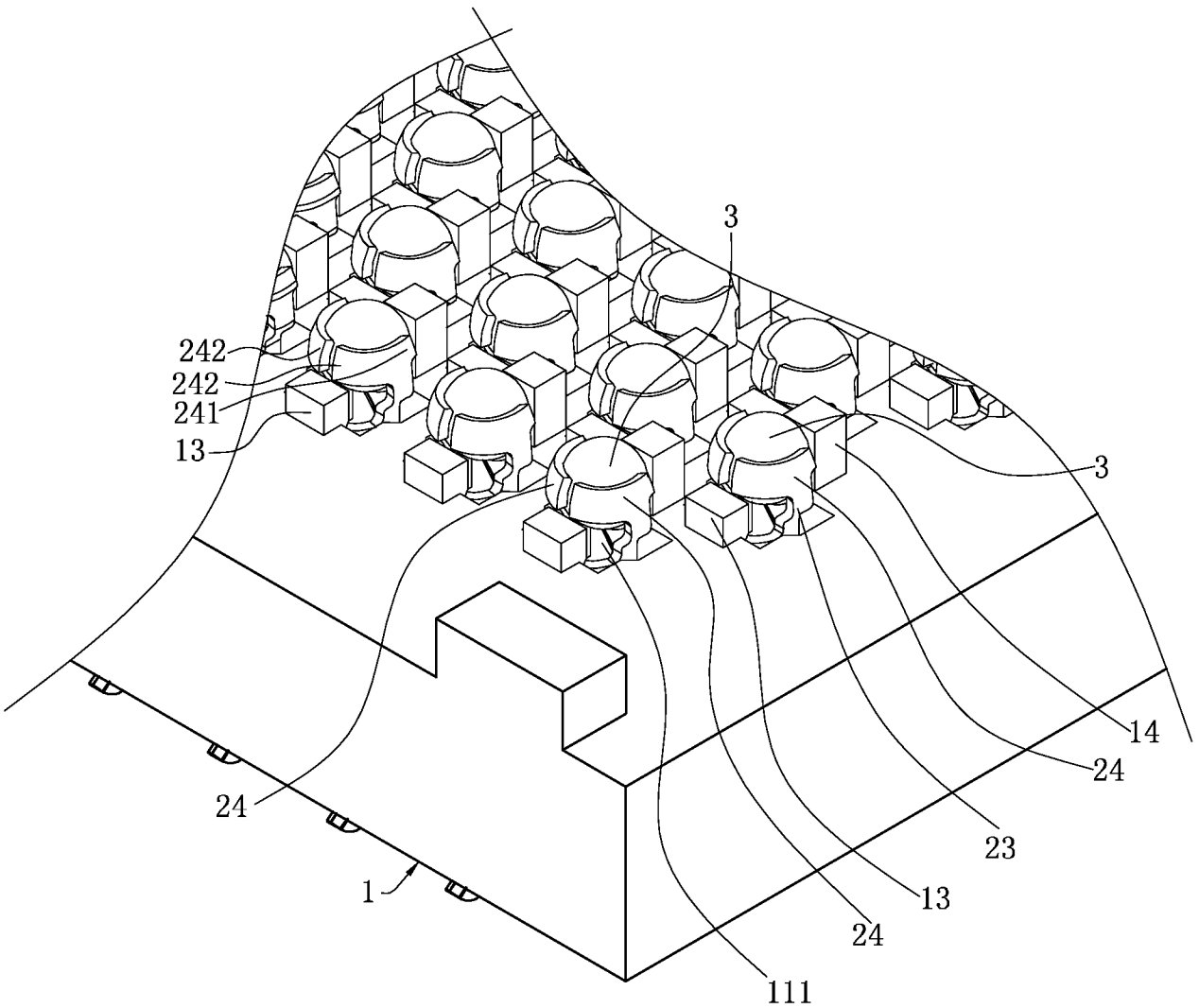
FIG. 9 is an inversed perspective view of FIG. 8.
Figure 10:
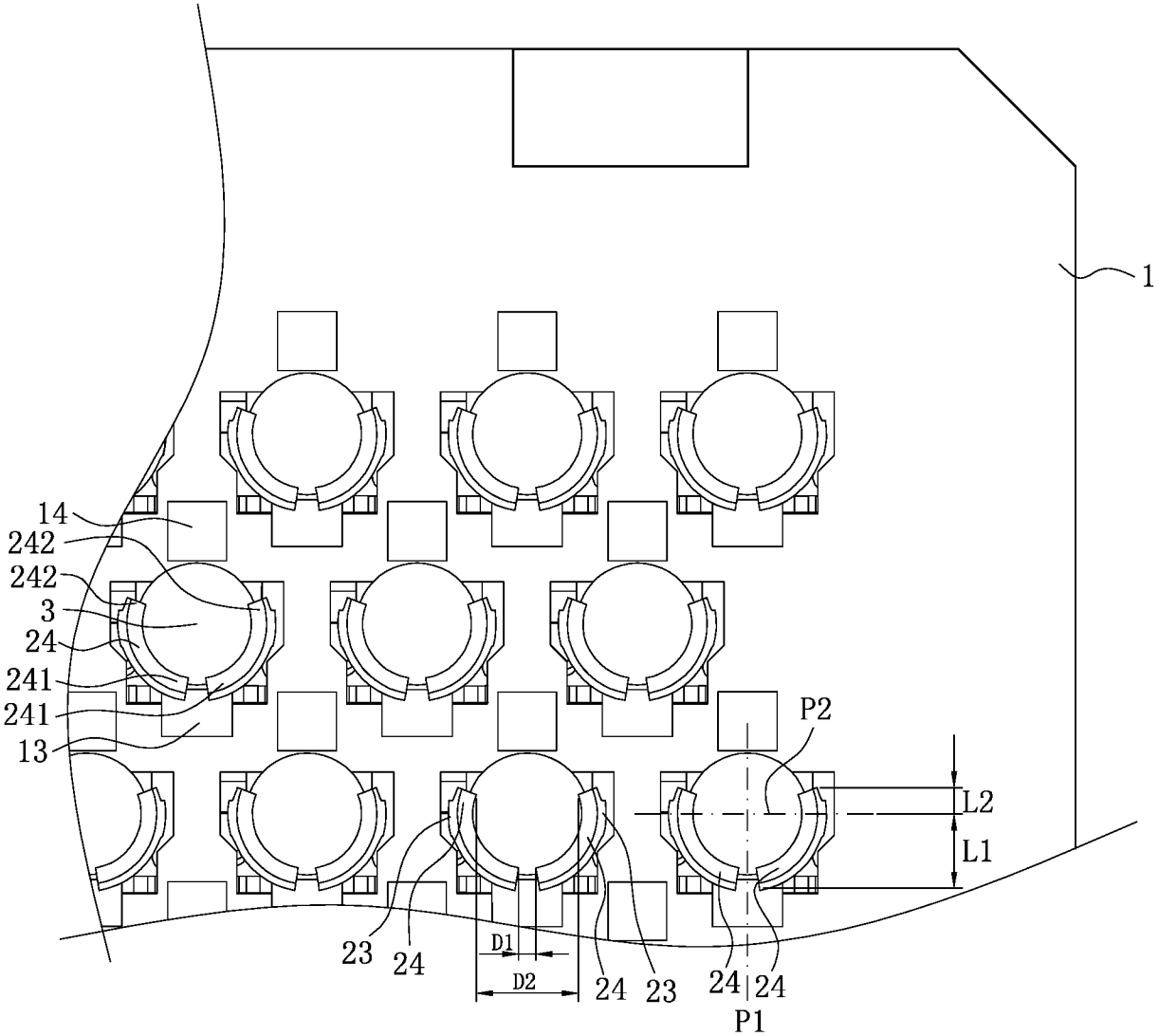
FIG. 10 is a bottom view of FIG. 8.
Figure 11:
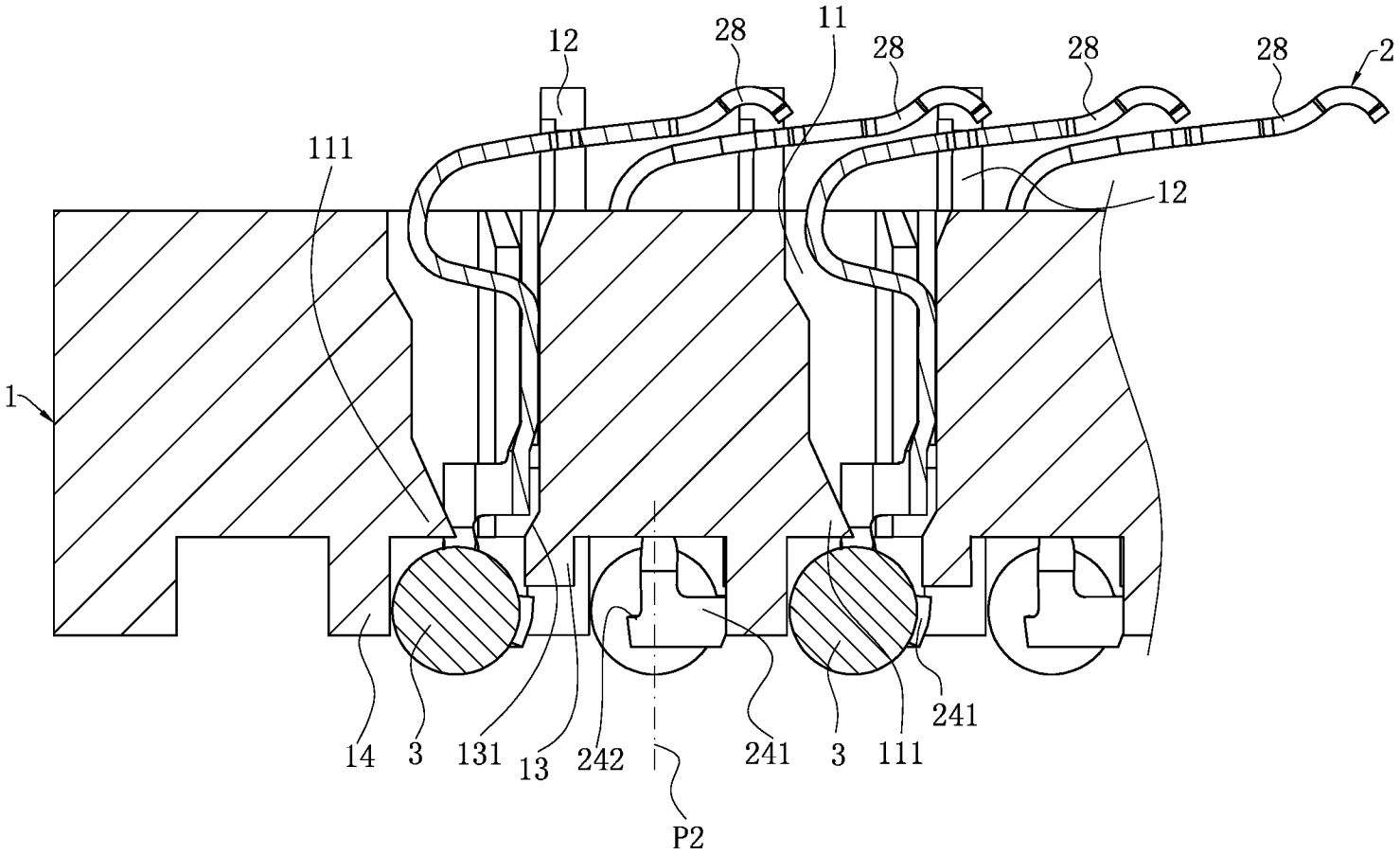
FIG. 11 is a sectional view of FIG. 8.
Figure 12:
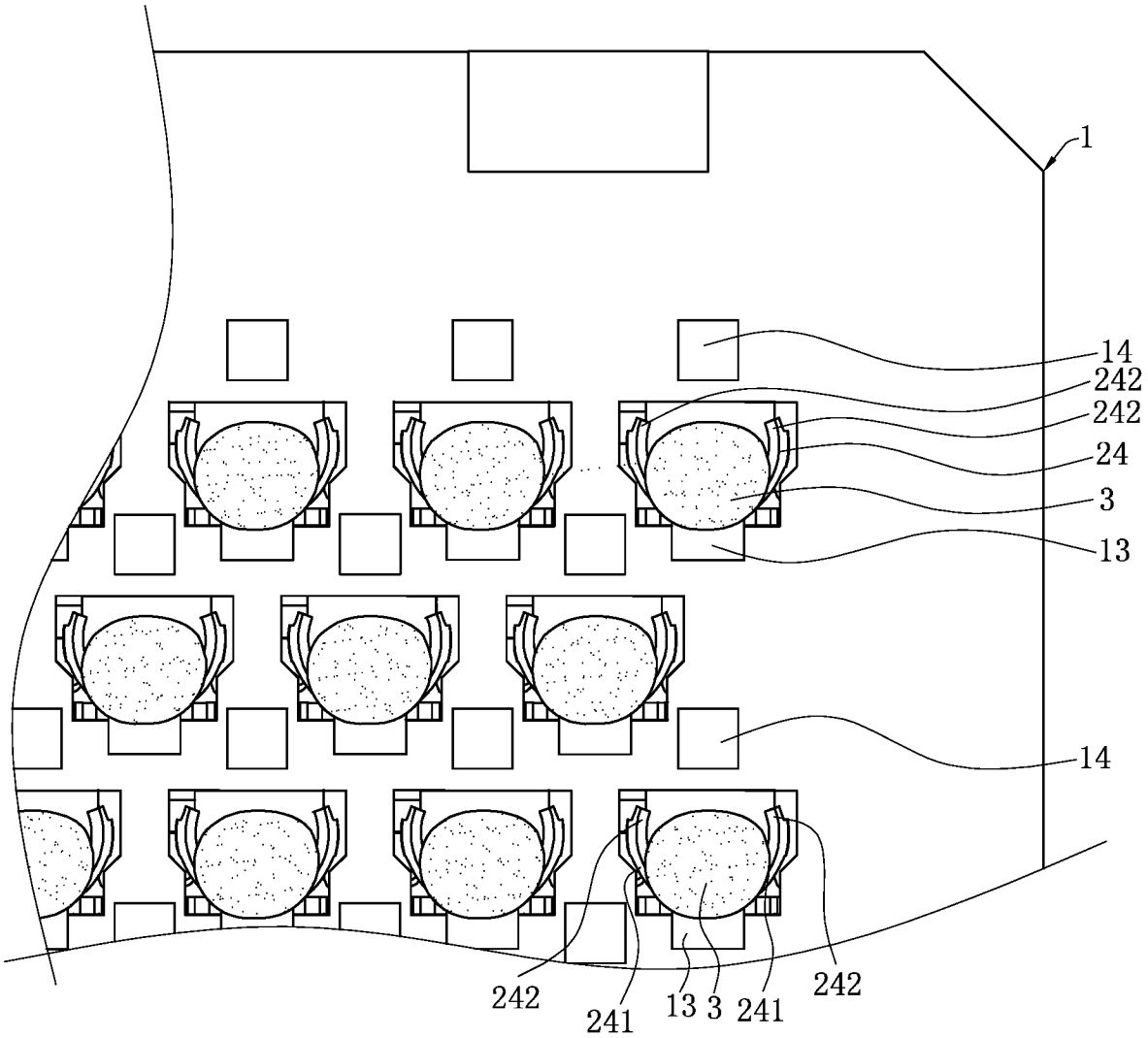
FIG. 12 is schematic view of FIG. 10 after the solder balls are melted.
Figure 13:
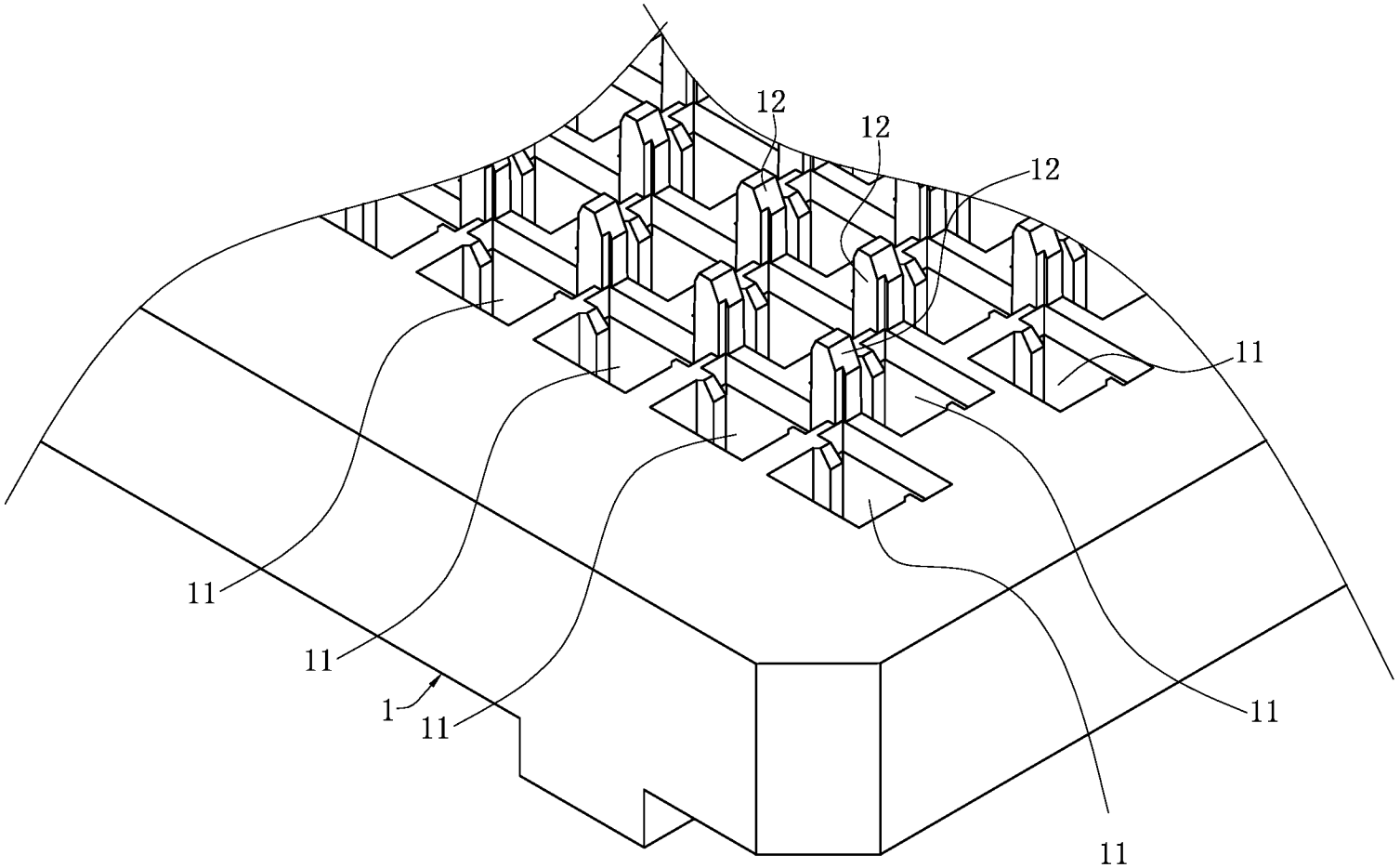
FIG. 13 is a perspective view of the insulating body of the electrical connector according to the second embodiment of the present invention.

As shown in FIG. 9, FIG. 10 and FIG. 13, the insulating body 1 is provided with a plurality of accommodating holes 11 running vertically through the insulating body 1 to correspondingly accommodate the terminals 2. A plurality of supporting blocks 12 protrude upward from an upper surface of the insulating body 1. Each supporting block 12 connects two adjacent inner walls of a corresponding accommodating hole 11. Specifically, each supporting block 12 is connected to a front inner wall and a left inner wall of a corresponding accommodating hole 11. Further, each supporting block 12 is connected to the inner walls of two accommodating holes 11 adjacently behind, and is connected to the inner wall of one accommodating hole 11 adjacently in front thereto, such that a width of each supporting block 12 along the front-rear direction is greater than a distance between a back inner wall of the accommodating hole 11 adjacently in front thereto and a front inner wall of each accommodating hole 11 adjacently behind. Thus, each supporting block 12 may be provided wider, thereby increasing the strength thereof. As shown in FIG. 11, a stopping portion 13 is provided to protrude from the front inner wall of each accommodating hole 11 and to extend downward beyond a lower end of the corresponding accommodating hole 11. The stopping portion 13 is provided with a guiding surface 131, which is formed to incline downward from the front inner wall of the corresponding accommodating hole 11, and a lowest end of the guiding surface 131 is flush with a lower end of the accommodating hole 11, such that the mold is convenient for machining. On a lower surface of the insulating body 1, a protruding block 14 protrudes downward behind each accommodating hole 11 to be downward supported on the circuit board 300. As shown in FIG. 11, the back inner wall of each accommodating hole 11 is protrudingly provided with a position limiting block 111, and the position limiting block 111 is flush with the lower end of the accommodating hole 11.

Figure 14:
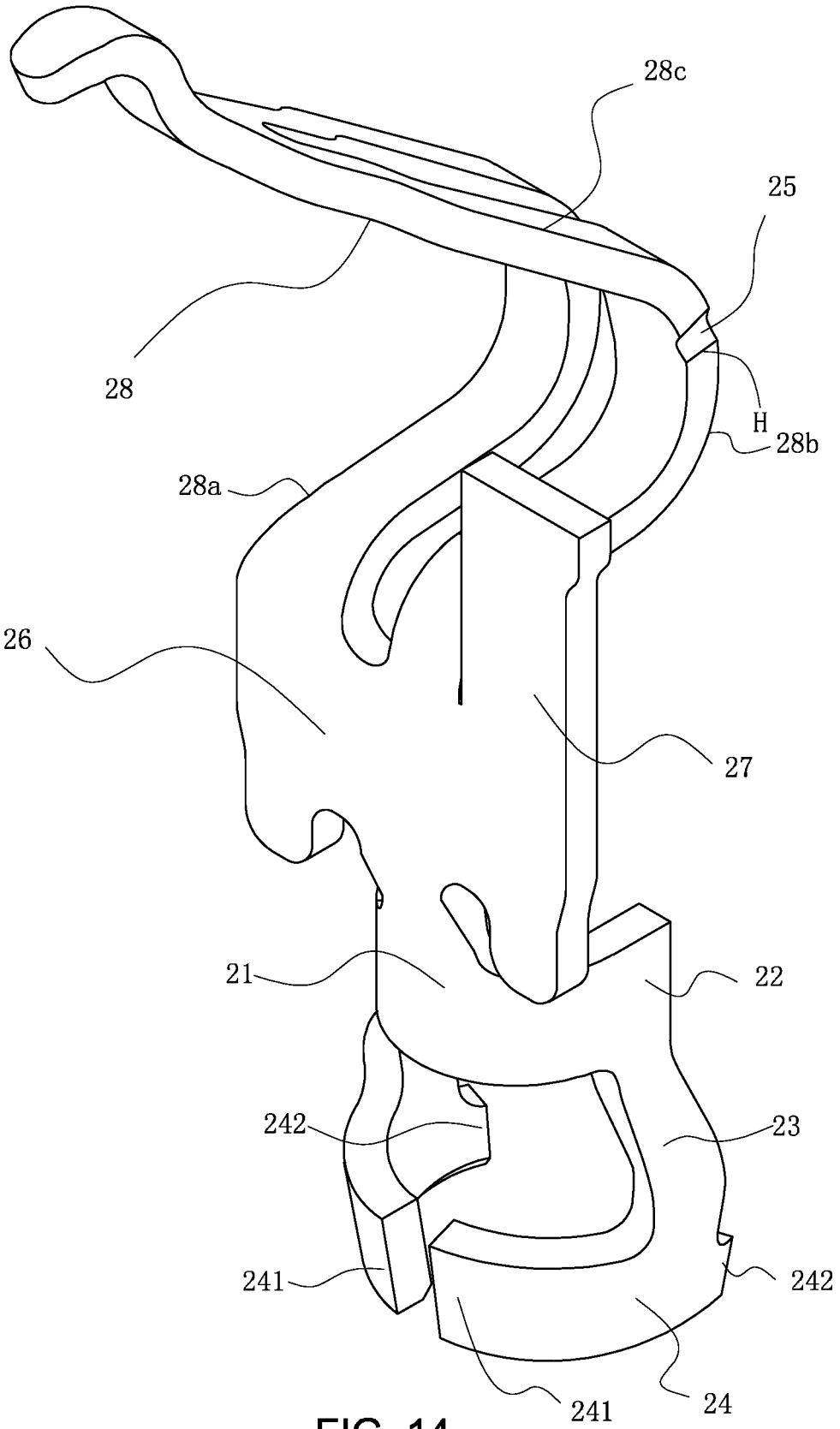
FIG. 14 is a perspective view of a terminal of the electrical connector according to the second embodiment of the present invention.

As shown in FIG. 9, FIG. 10 and FIG. 14, each terminal 2 has a base portion 26 positioned in a corresponding accommodating hole 11. The base portion 26 is in a vertical flat plate shape. A strip connecting portion 27 is formed by extending upward from the base portion 26 to be connected to a strip 4. An elastic arm 28 is formed by bending and extending backward from the base portion 26 and then bending and extending forward to upward abut the mating component 200. As shown in FIG. 10, the elastic arm 28 has a first tearing edge 28*a* formed by tearing from the strip connecting portion 27, a second tearing edge 28*b* formed by tearing from the strip 4, and a blanking edge 28*c* formed by blanking from the strip 4. A side of the elastic arm 28 close to the strip connecting portion 27 (that is, a left side of the elastic arm 28) is concavely provided with a notch 25, which is higher than the strip connecting portion 27. The notch 25 is located at a connecting location between the blanking edge 28*c* and the second tearing edge 28*b*. The notch 25 is provided to prevent the mold edge at the connecting location between the blanking edge 28*c* and the second tearing edge 28*b* from being provided with a sharp corner, thus prolonging the usage life of the mold.

Figure 15:
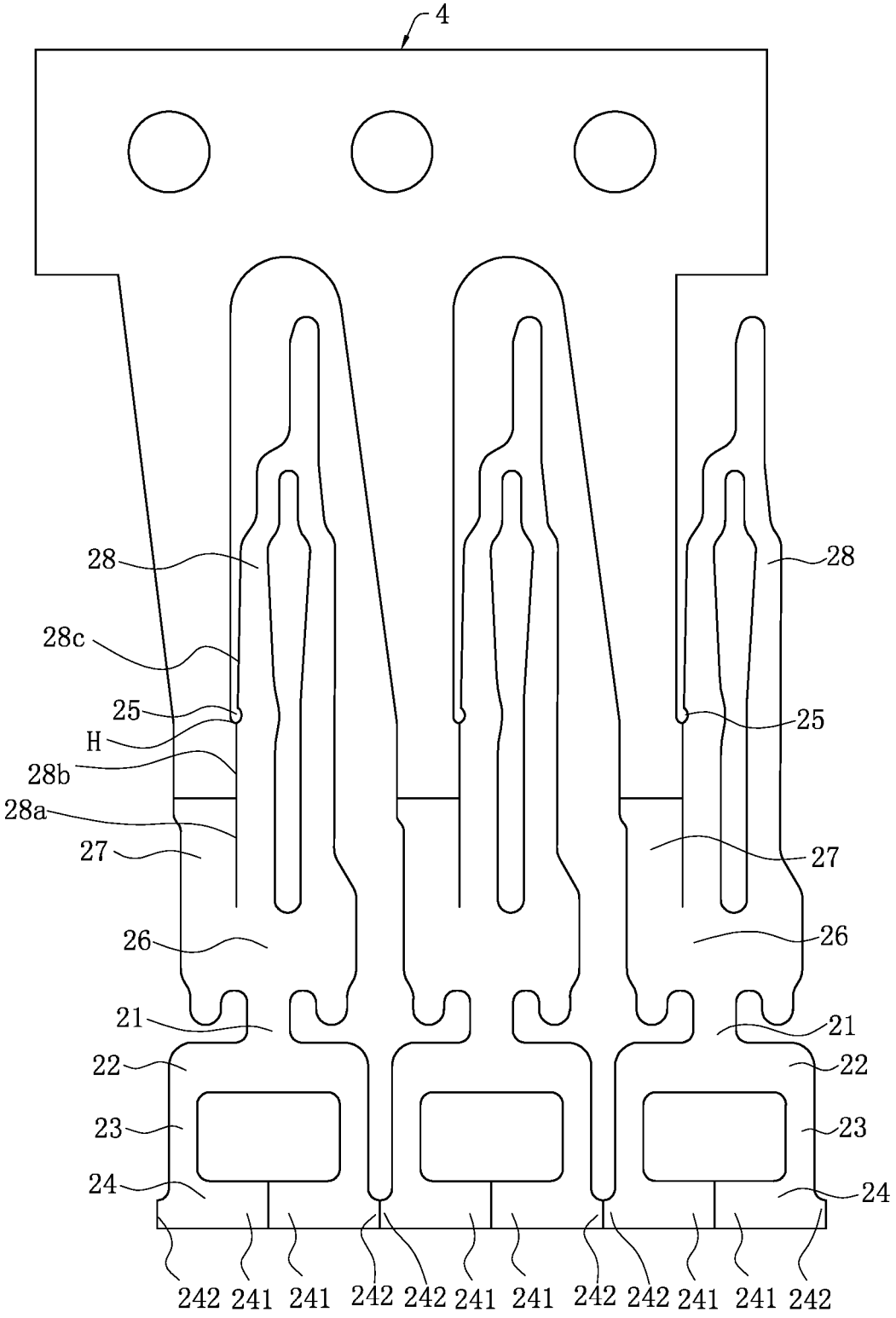
FIG. 15 is a plain expanded view of the terminals of the electrical connector being connected to a strip according to the second embodiment of the present invention.
Figure 16:
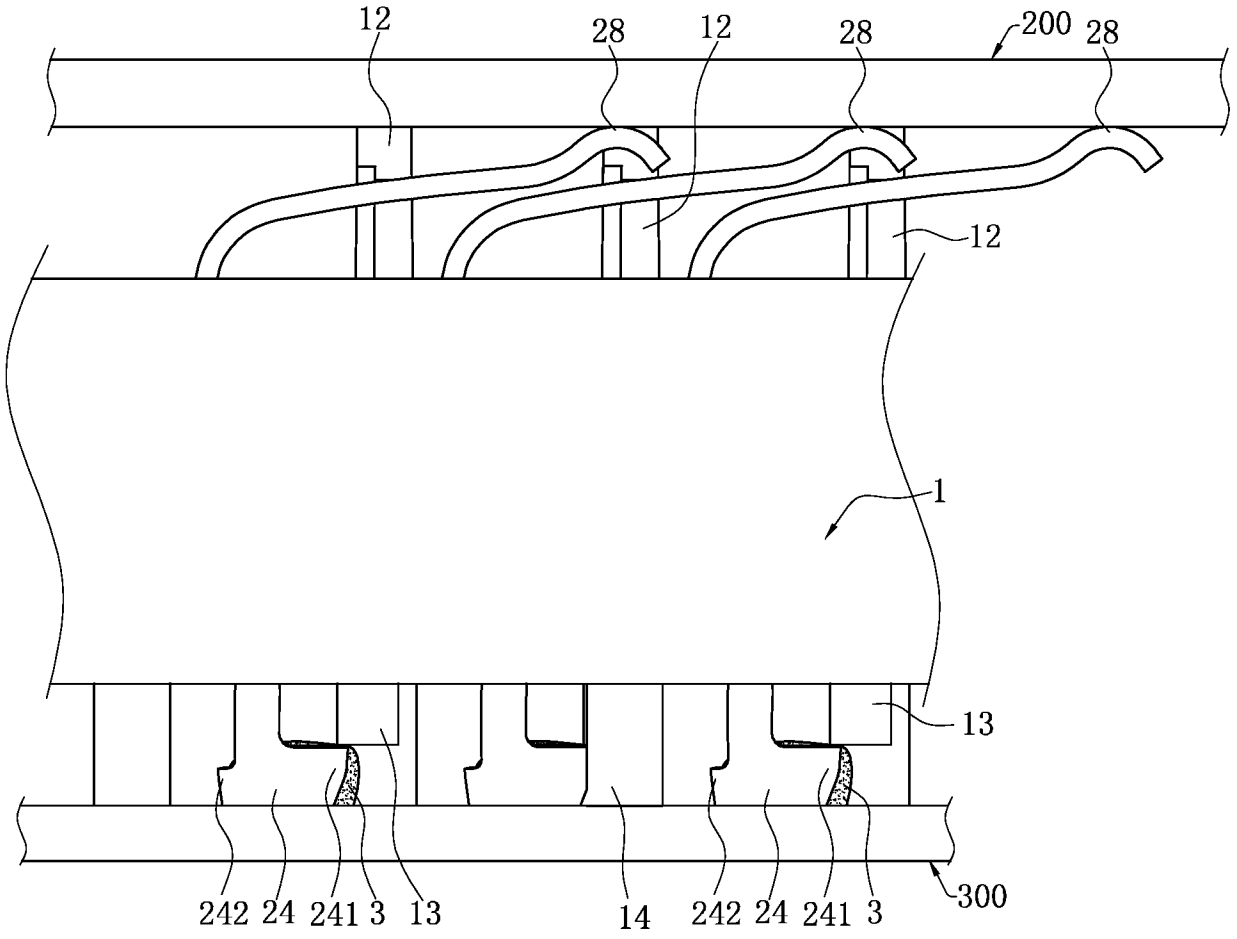
FIG. 16 is a schematic view of the terminals of the electrical connector electrically connecting a mating component and a circuit board according to the second embodiment of the present invention.

A connecting portion 21 is formed by bending and extending downward and backward from the base portion 26. A width of the connecting portion 21 is less than a width of the base portion 26, and the connecting portion 21 has better elasticity. Two side portions 22 are formed by bending and extending backward from a left side and a right side of the connecting portion 21. Two extending portions 23 are formed by extending downward from the two side portions 22 and expanding outward, and the two extending portions 23 are provided opposite to each other. Two embracing arms 24 are respectively correspondingly connected to lower ends of the two extending portions 23. The stopping portion 13 is located above front ends of the two embracing arms 24 to block the front ends of the embracing arms 24 from moving upward. The guiding surface 131 guides the embracing arms 24 to move downward and protrude out of the lower end of the corresponding accommodating hole 11. The two embracing arms 24 retain a solder ball 3. In this embodiment, the solder ball 3 has a diameter of 0.52 mm, and the solder ball 3 is used to solder the terminal 2 to the circuit board 300 by melting. The solder ball 3 defines a first vertical central plane P1 along the front-rear direction and a second vertical central plane P2 along the left-right direction, and the second vertical central plane P2 is perpendicular to the first vertical central plane P1. The second vertical central plane P2 passes the two extending portions. The two embracing arms 24 are located respectively at a left side and a right side of the first vertical central plane P1, thereby limiting the solder ball 3 from moving in the left-right direction. The front end of each of the two embracing arms 24 passes forward beyond the second vertical central plane P2, and the back end of each of the two embracing arms 24 passes backward beyond the second vertical central plane P2, thereby limiting the solder ball 3 from moving in the front-rear direction. A distance L1 of the front end of each of the two embracing arms 24 passing forward beyond the second vertical central plane P2 is greater than a distance L2 of a back end of each of the two embracing arms 24 passing backward beyond the second vertical central plane P2, such that a distance D1 between the front ends of the two embracing arms 24 is less than a distance D2 between the back ends of the two embracing arms 24, and the front ends of the two embracing arms 24 are close to each other, such that the front ends of the two embracing arms 24 are both attached with molten solder formed by the solder ball 3 being melted during soldering. When the solder ball 3 is not melted, the two embracing arms 24 of the same terminal 2 are elastically shoved outward by the solder ball 3. In this case, the distance D1 between the front ends of the two embracing arms 24 is within 0.15 mm. When the solder ball 3 is melted to form molten solder, the two embracing arms 24 elastically return and the front ends of the two embracing arms 24 move closer to each other, and the distance D1 between the front ends of the two embracing arms 24 is reduced to be within 0.10 mm. Thus, the gap between the front ends of the two embracing arms 24 is filled by the molten solder. The front end of each of the two embracing arms 24 passes forward beyond a front end of a corresponding extending portion 23. A portion of each of the two embracing arms 24 passing forward beyond the front end of the corresponding extending portion 23 is defined as a first protruding portion 241. A top end of the first protruding portion 241 is higher than a center of the solder ball 3, and a bottom end of the first protruding portion 241 is lower than the center of the solder ball 3. The first protruding portion 241 is inclined downward from top thereof toward a direction close to the solder ball 3. As shown in FIG. 15, when the two embracing arms 24 are expanded on a same plane, the two first protruding portions 241 of the same terminal 2 are connected to each other, and the two first protruding portions 241 are formed by tearing from each other, such that the two first protruding portions 241 may be provided with the greatest lengths. The back end of each of the two embracing arms 24 passes backward beyond a back end of the corresponding extending portion 23. (In other embodiments, the back end of each of the two embracing arms 24 may be flush with the back end of the corresponding extending portion 23.) A portion of each of the two embracing arms 24 passing backward beyond the back end of the corresponding extending portion 23 is defined as a second protruding portion 242, and a length of the first protruding portion 241 is greater than a length of the second protruding portion 242. The second protruding portion 242 is inclined downward from top thereof toward a direction close to the solder ball 3, and a top end of the second protruding portion 242 is not higher the center of the solder ball 3. In other words, the top end of the second protruding portion 242 is at a same height as or lower than the center of the solder ball 3, for the convenience of bending the second protruding portion 242. When the terminals 2 are connected to a same strip 4 and expanded on a same plane, the two adjacent second protruding portions 242 of two adjacent terminals 2 are connected to each other. Thus, the two adjacent second protruding portions 242 of the two adjacent terminals 2 are arranged to have a zero distance therebetween, such that the terminals 2 connected to the same strip 4 may be arranged more densely, a distance between the virtual center lines of the two adjacent terminals 2 becomes smaller, thus reducing blanking of the punching process and saving the material. The protruding block 14 is used to limit the solder ball 3 from moving backward in the process for the solder ball 3 to mount upward therein. When the solder ball 3 is mounted between the two embracing arms 24 of the corresponding terminal 2, the solder ball 3 is not in contact with the corresponding protruding block 14. Since the solder ball 3 is retained and fixed by the two embracing arms 24 of the corresponding terminal 2, the fixing of the solder ball 3 does not require involvement of the insulating body 1, thereby preventing the insulating body 1 from being applied with a force, and reducing the warping and deforming of the insulating body 1. The position limiting block 111 is located above the solder ball 3 to block the solder ball 3 from moving upward excessively in the process of mounting into the accommodating hole 11.

Figure 8:
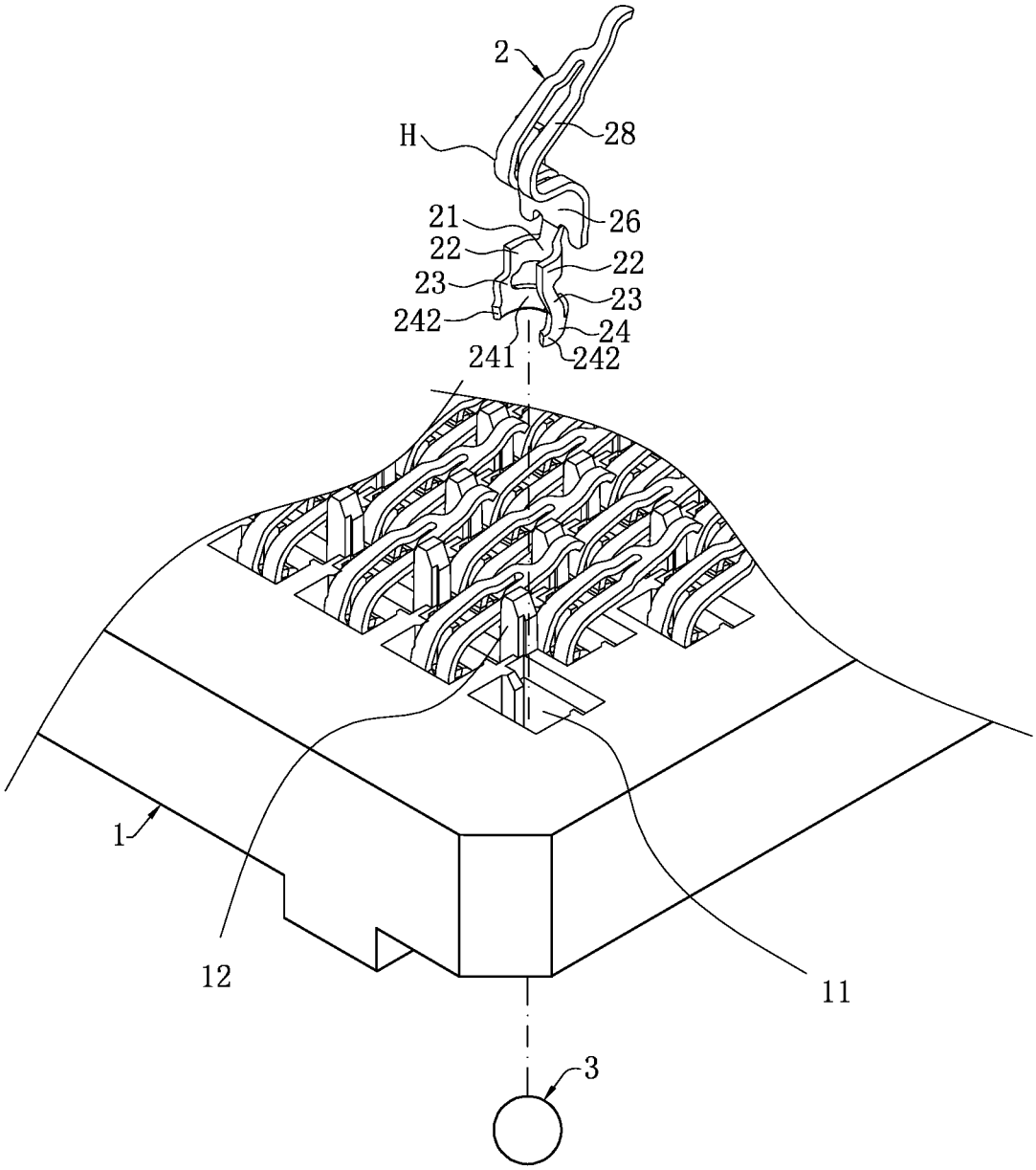
FIG. 8 is a perspective view of an electrical connector according to a second embodiment of the present invention.

As shown in FIG. 8, FIG. 14 and FIG. 15, a top point of the second tearing edge 28*b* is the dividing point H. A portion of the elastic arm 28 passing upward beyond the dividing point H is located at a side of the first tearing edge 28*a* away from the strip connecting portion 27, and a gap and no contact exists between the portion of the elastic arm 28 passing upward beyond the dividing point H and the strip 4 in the left-right direction. The dividing point H and the first tearing edge 28*a* are located at a back side of the strip connecting portion 27. Thus, in the process of folding the strip 4, the strip 4 does not easily collide and scratch the elastic arm 28, and the terminal 2 does not easily turn and deform.

In sum, the electrical connector according to certain embodiments of the present invention has the following beneficial effects:

1. The second tearing edge 28*b*' or the blanking edge 28*c*' has the dividing point H'. When each terminal 2' is connected to the strip 4' and expanded in a same plane along the vertical direction, the dividing point H' and a top point of the first tearing edge 28*a*' are vertically aligned, and a portion of the elastic arm 28' passing upward beyond the dividing point H' is located at a side of the first tearing edge 28*a*' away from the corresponding strip connecting portion 27'. That is, along the left-right direction, the portion of the elastic arm 28' passing upward beyond the dividing point H' is located between the two strip connecting portions 27', and a gap and no contact exists between the portion of the elastic arm 28' passing upward beyond the dividing point H' and the strip 4'. After the elastic arm 28' is formed by bending, the dividing point H' and the first tearing edge 28*a*' are both located at a back side of the corresponding strip connecting portion 27', and the terminal 2' has good stability, which is conducive to the normal usage of the electrical connector 100'.

2. The top point of the second tearing edge 28*b*' is lower than or flush with the top end of the corresponding strip connecting portion 27'. In the process of removing the strip 4' from the corresponding strip connecting portion 27' (where a degree of folding the strip 4' in the front-rear direction is less than 90°), it is further ensured that the strip 4' does not collide and scratch the second tearing edge 28*b*', the terminal 2' does not easily turn and deform, and the terminal 2' has good stability.

3. In the process of the mating component 200' pressing downward on the elastic arm 28', the top point of the second tearing edge 28*b*' and the first tearing edge 28*a*' are always located at a back side of the corresponding strip connecting portion 27', such that the corresponding strip connecting portion 27' is not in contact with the second tearing edge 28*b*'. Thus, the terminal 2' does not easily turn and deform, and the terminal 2' has good stability. Further, the top point of the second tearing edge 28*b*' is located below the corresponding strip connecting portion 27', further ensuring that, in this process, the elastic arm 28' is not collided and scratched by the corresponding strip connecting portion 27', and the terminal 2' has good stability, and reducing an overall height of the electrical connector 100'.

4. The distance D1 between the front ends of the two embracing arms 24 is less than the distance D2 between the back ends of the two embracing arms 24, and the front ends of the two embracing arms 24 are close to each other. During soldering, the solder ball 3 is melted to form molten solder, and the short distance may draw the molten solder, such that the front ends of the two embracing arms 24 are both attached with molten solder formed by the solder ball 3 being melted. The two embracing arms 24 are both attached with the molten solder, thereby ensuring the impedance of the terminals 2 to be identical.

5. The notch 25' is provided to be in a curve shape, thus preventing the mold edge at the connecting location between the blanking edge 28*c*' and the second tearing edge 28*b*' from being provided with a sharp corner, thus prolonging the usage life of the mold. In the first embodiment, the notch 25' is concavely provided on the strip 4'. Compared to the second embodiment in which the notch 25 is provided on the elastic arm 28, the terminal 2' has better stability, preventing the terminal 2' from having stress concentration at the location of the notch 25' and easily breaking.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector, comprising:

an insulating body, provided with a plurality of accommodating holes running vertically through the insulating body; and a plurality of terminals, respectively correspondingly accommodated in the accommodating holes, wherein each of the terminals has a base portion positioned in a corresponding one of the accommodating holes, a strip connecting portion formed by extending upward from the base portion to be connected to a strip, and an elastic arm formed by bending and extending backward from the base portion and then bending and extending forward to upward abut a mating component, wherein the elastic arm has a first tearing edge formed by tearing from the strip connecting portion, a second tearing edge formed by tearing from the strip, and a blanking edge formed by blanking from the strip, and the second tearing edge or the blanking edge has a dividing point, wherein when each of the terminals is connected to the strip and expanded in a same plane along a vertical direction, the dividing point and a top point of the first tearing edge are vertically aligned, and a portion of the elastic arm passing upward beyond the dividing point is located at a side of the first tearing edge away from the strip connecting portion; and after the elastic arm is formed by bending, the dividing point and the first tearing edge are both located at a back side of the strip connecting portion.

2. The electrical connector according to claim 1, wherein after the elastic arm is formed by bending, the dividing point is lower than or flush with a top end of the strip connecting portion.

3. The electrical connector according to claim 1, wherein a connecting location of the strip corresponding to the second tearing edge and the blanking edge is concavely provided with a notch in a curve shape.

4. The electrical connector according to claim 1, wherein a connecting location between the blanking edge and the second tearing edge is concavely provided with a notch in a curve shape.

5. The electrical connector according to claim 1, wherein a through slot runs through the elastic arm in a front-rear direction, a bottom end of the through slot is higher than a bending location of the elastic arm connected to the base portion, and the bottom end of the through slot is lower than a top end of the strip connecting portion.

6. The electrical connector according to claim 1, wherein a through slot runs through the elastic arm in a front-rear direction, and viewing downward from an upper side, a free end of the elastic arm of a back terminal of the terminals and the through slot of a front terminal of the terminals partially overlap with each other.

7. The electrical connector according to claim 1, wherein a connecting portion is formed by extending downward from the base portion, two side portions are formed by bending and extending backward from a left side and a right side of the connecting portion, two extending portions are provided opposite to each other and formed by extending downward from the two side portions, two embracing arms are respectively correspondingly connected to lower ends of the two extending portions, the two embracing arms retain a solder ball, the solder ball defines a first vertical central plane along a front-rear direction and a second vertical central plane along a left-right direction, the second vertical central plane is perpendicular to the first vertical central plane, the two embracing arms are located respectively at a left side and a right side of the first vertical central plane, a front end of each of the two embracing arms passes forward beyond a front end of a corresponding one of the two extending portions, a distance of the front end of each of the two embracing arms passing forward beyond the second vertical central plane is greater than a distance of a back end of each of the two embracing arms passing backward beyond the second vertical central plane, such that a distance between the front ends of the two embracing arms is less than a distance between the back ends of the two embracing arms, and the front ends of the two embracing arms are close to each other, such that the front ends of the two embracing arms are both attached with molten solder formed by the solder ball being melted during soldering.

8. The electrical connector according to claim 7, wherein the insulating body is provided with a stopping portion, and the stopping portion is located above the front ends of the two embracing arms to stop the front ends of the two embracing arms from moving upward.

9. The electrical connector according to claim 7, wherein a portion of each of the two embracing arms passing forward beyond the front end of the corresponding one of the two extending portions is defined as a first protruding portion, each of the two embracing arms has a second protruding portion passing backward beyond a back end of the corresponding one of the two extending portions, a length of the first protruding portion is greater than a length of the second protruding portion, and the second vertical central plane passes the two extending portions.

10. An electrical connector, comprising:

an insulating body, provided with a plurality of accommodating holes running vertically through the insulating body; and a plurality of terminals, respectively correspondingly accommodated in the accommodating holes, wherein each of the terminals has a base portion positioned in a corresponding one of the accommodating holes, a strip connecting portion formed by extending upward from the base portion to be connected to a strip, and an elastic arm formed by bending and extending backward from the base portion and then bending and extending forward to upward abut a mating component, wherein the elastic arm has a tearing edge formed by tearing from the strip connecting portion, and a side edge of the terminal has a dividing point above the tearing edge, wherein when each of the terminals is connected to the strip and expanded in a same plane along a vertical direction, the dividing point and a top point of the tearing edge are vertically aligned, and a portion of the elastic arm passing upward beyond the dividing point is located at a side of the tearing edge away from the strip connecting portion; and in a process for the mating component to press downward on the elastic arm, the dividing point and the tearing edge are always located at a back side of the strip connecting portion, and the dividing point is lower than or flush with a top end of the strip connecting portion.

* * * * *